US007412818B2

(12) United States Patent
Doerner et al.

(10) Patent No.: US 7,412,818 B2
(45) Date of Patent: Aug. 19, 2008

(54) ROTOR SPINNING MACHINE

(75) Inventors: Wolfgang Doerner, Mönchengladbach (DE); Ralf Siewert, Schwalmtal (DE); Lorenz Kreitzen, Rheinberg (DE)

(73) Assignee: Oerlikon Textile GmbH & Co. KG, Monchengladbach (DE)

( * ) Notice: Subject to any disclaimer, the term of this patent is extended or adjusted under 35 U.S.C. 154(b) by 167 days.

(21) Appl. No.: 10/575,494

(22) PCT Filed: Sep. 17, 2004

(86) PCT No.: PCT/EP2004/010429

§ 371 (c)(1),
(2), (4) Date: Apr. 10, 2006

(87) PCT Pub. No.: WO2005/037700

PCT Pub. Date: Apr. 28, 2005

(65) Prior Publication Data

US 2007/0137167 A1 Jun. 21, 2007

(30) Foreign Application Priority Data

Oct. 16, 2003 (DE) ..... 103 48 706

(51) Int. Cl.
*D01H 9/00* (2006.01)

(52) U.S. Cl. ..... 57/404; 57/268; 57/276

(58) Field of Classification Search ..... 57/266, 57/268, 276, 277, 404
See application file for complete search history.

(56) References Cited

U.S. PATENT DOCUMENTS

| | | | | | |
|---|---|---|---|---|---|
| 4,720,967 | A | * | 1/1988 | Guttler | 57/281 |
| 4,821,504 | A | * | 4/1989 | Shinkai et al. | 57/276 |
| 4,840,022 | A | * | 6/1989 | Karl et al. | 57/263 |
| 4,970,856 | A | * | 11/1990 | Taniguchi et al. | 57/281 |
| 4,979,360 | A | * | 12/1990 | Kallmann et al. | 57/281 |
| 5,237,807 | A | * | 8/1993 | Iwade et al. | 57/261 |
| 5,273,224 | A | | 12/1993 | Nakagawa et al. | 242/35.5 |
| 5,299,750 | A | | 4/1994 | Nakagawa et al. | 242/35.5 |

FOREIGN PATENT DOCUMENTS

| | | |
|---|---|---|
| DE | 42 17 575 A1 | 12/1992 |
| DE | 199 05 856 A1 | 8/2000 |

* cited by examiner

*Primary Examiner*—Shaun R Hurley
(74) *Attorney, Agent, or Firm*—K&L Gates LLP

(57) ABSTRACT

A rotor spinning machine of the type comprising a plurality of working stations and a bobbin supplying device extending along the machine, wherein at least two service units supplying the working stations with bobbins are supplied by the supply device and wherein the rotor spinning machine comprises a control device for controlling the service units. The control device is configured in such a way that it suppresses a subsequent bobbin request from the second service unit in the event of an existing bobbin request from the first service unit positioned downstream in relation to the transporting direction of the supply device, until the initially existing bobbin request has been fulfilled.

4 Claims, 2 Drawing Sheets

ROTOR SPINNING MACHINE

CROSS-REFERENCE TO RELATED APPLICATIONS

This application claims the benefit of German patent application 10348706.9, filed Oct. 16, 2003, herein incorporated by reference.

BACKGROUND OF THE INVENTION

The invention relates to a rotor spinning machine and, more particularly, to a rotor spinning machine having plurality of working stations and a bobbin supplying device extending along the machine, wherein at least two service units supplying the working stations with bobbins are supplied by the supply device and wherein the rotor spinning machine comprises a control device for controlling the service units.

Service units are used on rotor spinning machines and can be moved on guide rails on the longitudinal sides of the rotor spinning machine. Starting spinning after a thread break and supplying the spinning stations of the rotor spinning machine with bobbins belongs to the tasks of the service devices. In order to keep the stoppage times of the spinning stations as short as possible in the event of a thread break or bobbin change, a plurality of service units are used on a rotor spinning machine, for example two service units on each longitudinal side of the machine.

German Patent Publication DE 199 05 856 A1 describes a rotor spinning machine, which, between its end frames, has a plurality of working stations, which are arranged on the two longitudinal sides of the machine. These working stations each have a spinning mechanism and a downstream winding mechanism and are supplied by a plurality of service units during operation. A service unit is requested and positioned at the working station for a bobbin change at a working station. From the bobbin magazine, a bobbin is requested, which is transported by means of a conveyor belt to the working station. The service unit has a device, with which the bobbin delivered can be removed from the conveyor belt. The bobbin is then positioned in the winding station in the operating position.

When the service unit operating further away from the bobbin magazine requests a bobbin first and, before the bobbin has arrived at this first service unit, the second service unit positioned closer to the bobbin magazine also requests a bobbin, it may occur that the bobbin intended for the first service unit is removed from the conveyor belt by the second service unit. Delays occur as a result, which can lead to undesired long stoppages of working stations.

SUMMARY OF THE INVENTION

The object of the invention is to avoid undesired removals of this type of bobbins from the conveyor belt.

This object is achieved according to the invention by a rotor spinning machine of the type comprising a plurality of working stations and a bobbin supplying device extending along the machine, wherein at least two service units supplying the working stations with bobbins are supplied by the supply device and wherein the rotor spinning machine comprises a control device for controlling the service units. According to the invention, the control device is configured in such a way that it suppresses a subsequent bobbin request from the second service unit in the event of an existing bobbin request from the first service unit positioned downstream in relation to the transporting direction of the supply device, until the initially existing bobbin request has been fulfilled.

Advantageous further configurations of the invention are described below.

The control device of the rotor spinning machine is configured according to the invention in such a way that it suppresses a subsequent bobbin request from the second service unit in the event of an existing bobbin request from the first service unit positioned downstream in relation to the transporting direction of the supply device, until the initially existing bobbin request has been fulfilled. As a result, undesired removals of bobbins from the conveyor belt by the service unit requesting a bobbin secondly, are avoided. The service unit initially requesting a bobbin is not prevented by too long a service stop at a working station from rapidly fulfilling optionally existing requests from further working stations.

The control device may be configured in such a way that an existing first bobbin request is considered fulfilled when the first service unit requesting the bobbin has received a bobbin. The control device may also be configured in such a way that an existing first bobbin request is considered fulfilled when the first requested bobbin has passed the second service unit. The control device may be a central machine control device. With such a rotor spinning machine, the time in which the subsequent bobbin request from the second service unit is suppressed, is kept as short as possible. Expediently, the control device is a central machine control device, to keep the outlay for control as low as possible.

With the rotor spinning machine according to the invention, undesired removals of bobbins from the transport belt are prevented. By the avoidance of unnecessary stoppage times, the productivity of the machine is improved.

BRIEF DESCRIPTION OF THE DRAWINGS

Further details of the invention emerge from the figures. In the drawings.

DESCRIPTION OF THE PREFERRED EMBODIMENT

Figure 1:
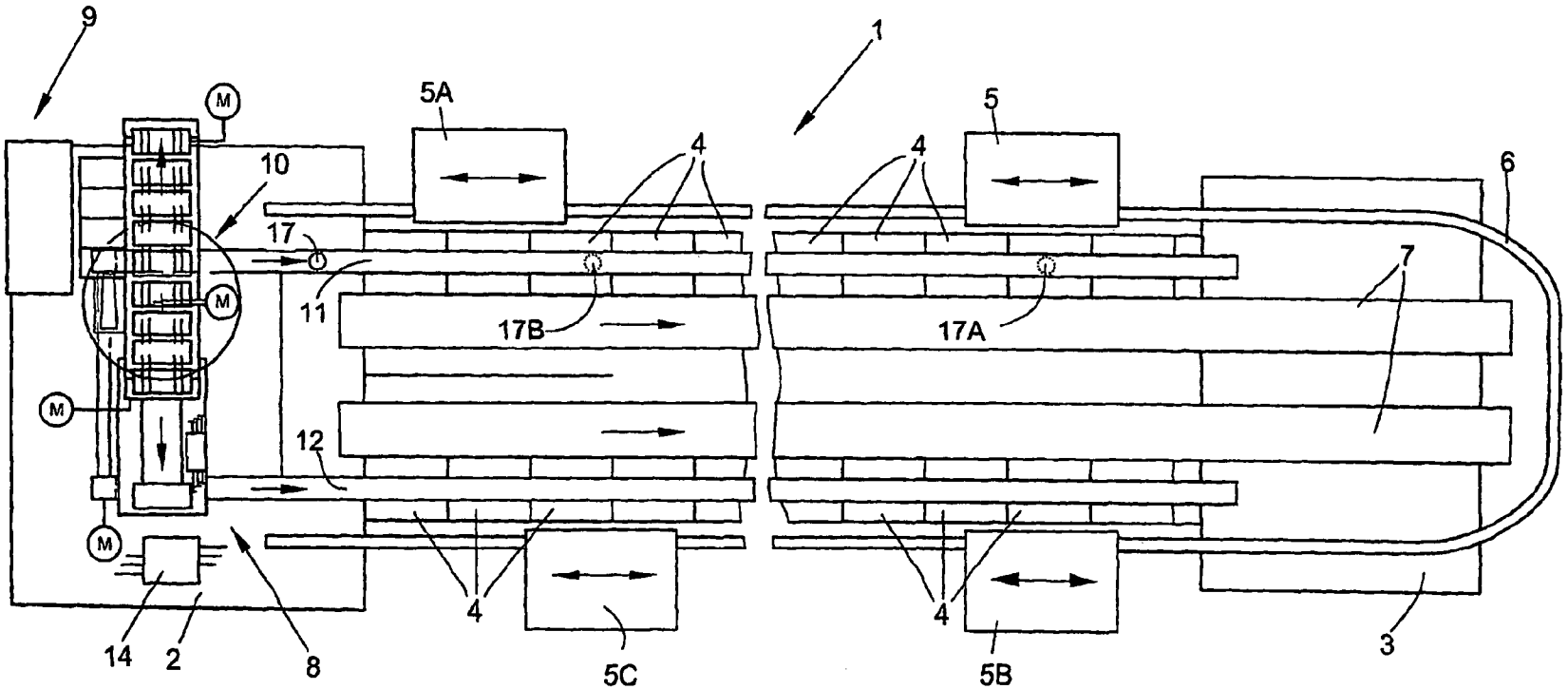
FIG. 1 shows a rotor spinning machine with service units.

The rotor spinning machine 1 shown in FIG. 1 has, between its end positions 2 and 3, a plurality of working stations 4, which are arranged on the two longitudinal sides of the machine. The working stations 4, which in each case comprise a spinning mechanism and a winding mechanism, are supplied by four service units 5, 5A, 5B, 5C. The service units 5, 5A, 5B, 5C can be moved along the machine sides on a rail construction 6. If a thread break has occurred at one of the working stations 4, or a bobbin change is to take place, one of the service units 5, 5A, 5B, 5C automatically becomes active. The rotor spinning machine 1 also comprises a cross-wound bobbin transporting device 7 arranged between the working stations 4, for conveying away completed cross-wound bobbins, as well as a bobbin delivery device 8. The bobbin delivery device 8 comprises in this case a central bobbin magazine 9 that is arranged on the end of the machine, a bobbin distribution device 10 and two bobbin conveyor belts 11, 12 extending along the machine, each supplying the working stations 4 of a longitudinal side of the machine with bobbins.

Figure 2:
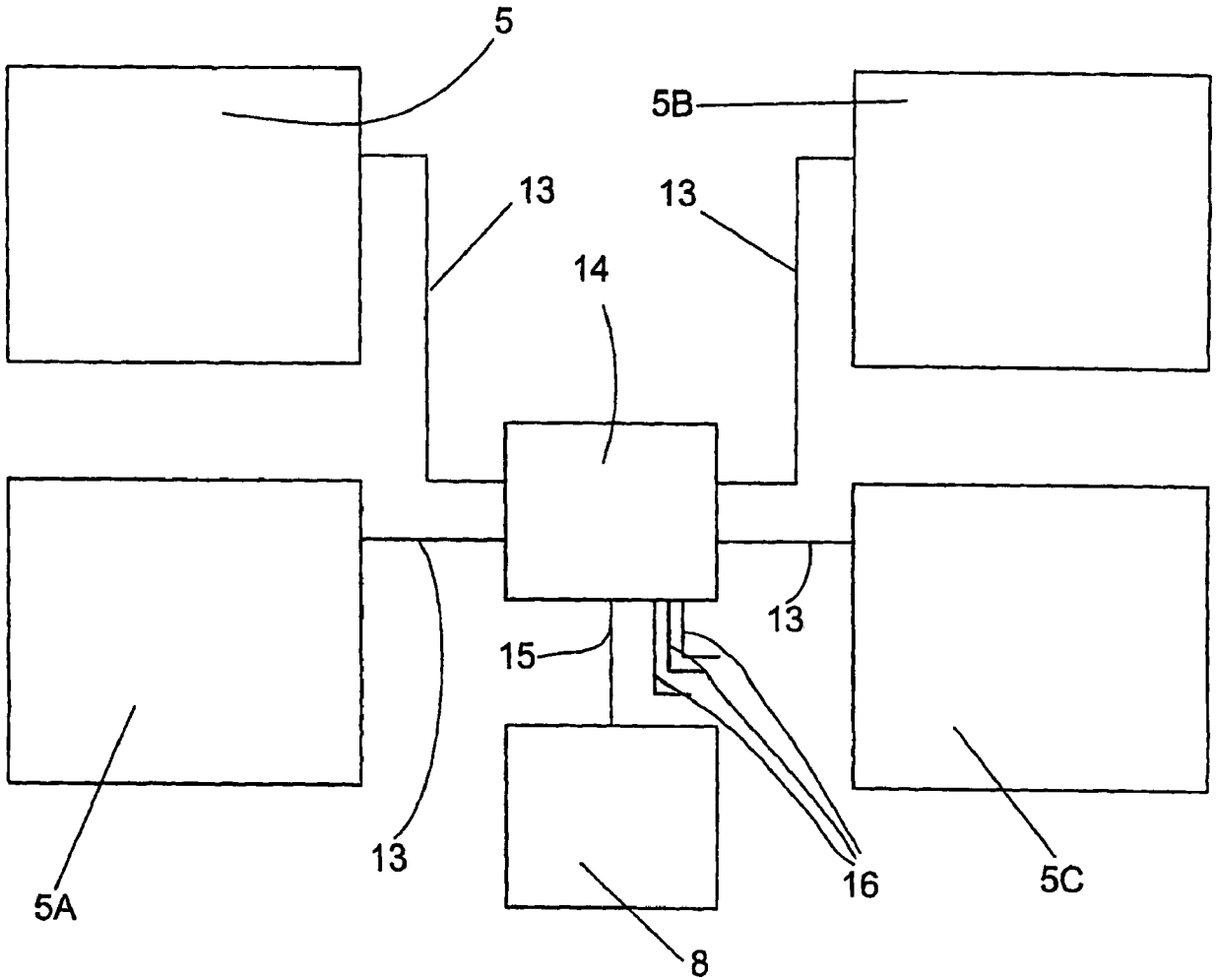
FIG. 2 shows a simplified schematic view of the control of the service units.

The service units 5, 5A, 5B, 5C are connected to the control device 14 via the lines 13 (FIG. 2). The control device 14 controls, as the central control device, the four service units 5, 5A, 5B, 5C and is in turn connected via the line 15 to the bobbin delivery device 8 and, via the lines 16, to other control devices and machine modules, not shown.

When, during the spinning operation at one of the working stations 4, a cross-wound bobbin has reached the diameter provided, this is to be exchanged as quickly as possible for a new bobbin. The exchange of the full cross-wound bobbin for an empty bobbin is carried out in the embodiment by the service unit 5. The service unit 5 travels to the requesting working station 4 and is positioned there. The service unit 5 requests a bobbin from the bobbin delivery device via the control device 14. The bobbin is placed on the conveyor belt 11. The bobbin is designated by the reference numeral 17 in FIG. 1. The bobbin is moved in the arrow direction from the conveyor belt in the direction of the service unit 5. Later than the service unit S but still during provision of the bobbin for the service unit 5, the service unit 5A has also taken up position at a working station 4 and also requires a bobbin. This request for the bobbin is suppressed by the control device 14 until the service unit 5 has received the bobbin 17 from the bobbin position designated 17A and shown by dotted lines. As an alternative, the bobbin request from the service unit 5A is only suppressed until the bobbin 17 has passed the service unit 5A and, for example, has reached the position, designated 17B, of a bobbin shown by dotted lines.

Once the bobbin request from the service unit 5A is no longer suppressed, a bobbin is transported on the conveyor belt 11 to the service unit 5A.

The service unit 5 can start up the working station 4 again without any unnecessary delay and process subsequent requests from working stations without delay.

The invention is not limited to the embodiment shown. Further embodiments of the rotor spinning machine are possible in the scope of the invention.

The invention claimed is:

1. A rotor spinning machine comprising:

a plurality of working stations, a bobbin supplying device disposed at a fixed position relative to the plurality of working stations, the bobbin supplying device including a conveyance device extending along the working stations for delivering bobbins to the individual working stations in a predetermined direction of bobbin conveyance, at least two service units arranged to travel along the working stations for transferring a bobbin from the conveyance device to an individual working station when in need of a new bobbin, each service unit adapted for transmitting a bobbin request to the bobbin supplying device for delivery of a bobbin along the conveyance device to an individual working station, and a control device for controlling the service units, the control device including an arrangement, operative when a first one of the service units transmits a bobbin request to the bobbin supplying device for a working station disposed more remotely from the fixed position of the bobbin supplying device in relation to the direction of bobbin conveyance than the disposition of a second one of the service units, to suppress a subsequent bobbin request from the second service unit for a working station disposed more closely to the bobbin supplying device in relation to the direction of bobbin conveyance until the bobbin request from the first service unit has been fulfilled, thereby to prevent the second service unit from taking from the conveyance device the bobbin being delivered to the first service unit.

2. Rotor spinning machine according to claim 1, characterized in that the control device (14) is configured in such a way that an existing first bobbin request is considered fulfilled when the first service unit (5) requesting the bobbin has received a bobbin (17).

3. Rotor spinning machine according to claim 1, characterized in that the control device (14) is configured in such a way that an existing first bobbin request is considered fulfilled when the first requested bobbin (17) has passed the second service unit (5A).

4. Rotor spinning machine according to claim 1, characterized in that the control device (14) is a central machine control device.

* * * * *